US009163525B2

(12) United States Patent
Alexander et al.

(10) Patent No.: US 9,163,525 B2
(45) Date of Patent: Oct. 20, 2015

(54) TURBINE WHEEL CATCHER

(75) Inventors: Eric J. Alexander, San Diego, CA (US); Behzad Hagshenas, San Diego, CA (US); Richard L. Elgin, San Diego, CA (US)

(73) Assignee: United Technologies Corporation, Hartford, CT (US)

( * ) Notice: Subject to any disclaimer, the term of this patent is extended or adjusted under 35 U.S.C. 154(b) by 609 days.

(21) Appl. No.: 13/534,085

(22) Filed: Jun. 27, 2012

(65) Prior Publication Data

US 2014/0003911 A1 Jan. 2, 2014

(51) Int. Cl.

| | |
|---|---|
| ***F01D 25/00*** | (2006.01) |
| ***F01D 9/04*** | (2006.01) |
| ***F01D 21/04*** | (2006.01) |

(52) U.S. Cl.

CPC *F01D 25/00* (2013.01); *F01D 9/04* (2013.01); *F01D 21/045* (2013.01); *F05D 2220/3215* (2013.01); *F05D 2220/50* (2013.01); *F05D 2240/14* (2013.01)

(58) Field of Classification Search

CPC ..... F01D 9/04; F01D 9/041; F05D 2240/14
USPC ..... 415/185, 189, 190, 191, 208.1, 208.2, 415/209.2, 210.1, 211.2
See application file for complete search history.

(56) References Cited

U.S. PATENT DOCUMENTS

| | | | | |
|---|---|---|---|---|
| 2,938,336 | A * | 5/1960 | Peterson | 60/39.5 |
| 2,941,781 | A * | 6/1960 | Boyum | 415/142 |
| 2,961,150 | A * | 11/1960 | Pirtle | 417/352 |
| 2,987,296 | A | 6/1961 | Ferguston, Jr. | |
| 3,398,535 | A * | 8/1968 | Hemsworth et al. | 60/226.1 |
| 3,403,889 | A * | 10/1968 | Ciokajlo | 415/220 |
| 3,908,683 | A * | 9/1975 | Demetrick | 137/15.1 |
| 3,937,238 | A * | 2/1976 | Stewart et al. | 137/15.1 |
| 4,981,018 | A | 1/1991 | Jones et al. | |
| 5,272,869 | A * | 12/1993 | Dawson et al. | 60/796 |
| 6,896,480 | B1 | 5/2005 | Hagshenas et al. | |
| 6,942,451 | B1 | 9/2005 | Alexander et al. | |
| 7,055,306 | B2 | 6/2006 | Jones et al. | |
| 7,124,572 | B2 * | 10/2006 | Aycock et al. | 60/39.511 |
| 7,194,866 | B1 | 3/2007 | Jones et al. | |
| 7,475,549 | B2 | 1/2009 | Alexander et al. | |
| 7,640,723 | B2 | 1/2010 | Alexander | |
| 7,806,596 | B2 | 10/2010 | Shatz et al. | |
| 8,070,432 | B2 * | 12/2011 | Sjunnesson | 415/209.4 |

(Continued)

FOREIGN PATENT DOCUMENTS

| | | | | |
|---|---|---|---|---|
| JP | 04308400 | A * | 10/1992 | F04D 29/54 |
| JP | 2004052598 | A * | 2/2004 | F01D 25/30 |

(Continued)

OTHER PUBLICATIONS

International Search Report and Written Opinion for PCT Application Serial No. PCT/US2013/048173; dated Oct. 9, 2013, 14 pages.

*Primary Examiner* — Ninh H Nguyen
*Assistant Examiner* — Christopher R Legendre
(74) *Attorney, Agent, or Firm* — Kinney & Lange, P.A.

(57) ABSTRACT

A catcher for a gas turbine engine includes a central hub, a plurality of struts, and a first ring. The plurality of struts are connected to and extend outward from the central hub. The first ring is connected to a mid-section of the plurality of struts and extends therebetween.

19 Claims, 2 Drawing Sheets

(56) References Cited

U.S. PATENT DOCUMENTS

| | | | | |
|---|---|---|---|---|
| 8,143,759 | B2 | 3/2012 | Allen et al. | |
| 8,756,911 | B1 * | 6/2014 | Liang | 60/269 |
| 8,776,527 | B1 * | 7/2014 | Sokhey et al. | 60/770 |
| 8,915,090 | B2 * | 12/2014 | Praisner et al. | 60/796 |
| 9,032,721 | B2 | 5/2015 | Orosa et al. | |
| 2005/0268593 | A1 | 12/2005 | Hagshenas | |
| 2006/0042270 | A1 | 3/2006 | Thompson et al. | |
| 2007/0028589 | A1 | 2/2007 | Alexander et al. | |
| 2007/0137217 | A1 | 6/2007 | Alexander | |
| 2008/0131277 | A1 | 6/2008 | Shatz et al. | |
| 2008/0310958 | A1 * | 12/2008 | Bader et al. | 415/208.2 |
| 2009/0060405 | A1 | 3/2009 | Shatz et al. | |
| 2009/0074338 | A1 | 3/2009 | Hagshenas et al. | |
| 2009/0078496 | A1 | 3/2009 | Francisco et al. | |
| 2010/0215508 | A1 | 8/2010 | Hagshenas et al. | |
| 2011/0072823 | A1 | 3/2011 | Chen et al. | |
| 2011/0073745 | A1 * | 3/2011 | Duchatelle et al. | 248/637 |
| 2011/0142653 | A1 | 6/2011 | Hagshenas et al. | |
| 2011/0308229 | A1 | 12/2011 | Hagshenas | |
| 2012/0020771 | A1 | 1/2012 | Hollman et al. | |
| 2012/0024985 | A1 | 2/2012 | Johnson et al. | |
| 2012/0048530 | A1 | 3/2012 | Hagshenas et al. | |
| 2014/0003911 | A1 * | 1/2014 | Alexander et al. | 415/121.2 |
| 2015/0013332 | A1 * | 1/2015 | Nasir et al. | 60/605.2 |
| 2015/0033759 | A1 * | 2/2015 | Sjoqvist | 60/796 |

FOREIGN PATENT DOCUMENTS

| | | | |
|---|---|---|---|
| JP | 2011525953 | A | 9/2011 |
| KR | 20110033552 | A | 3/2011 |

* cited by examiner

TURBINE WHEEL CATCHER

BACKGROUND

The invention relates generally to turbomachinery, and more particularly to a containment structure for a gas turbine engine.

Auxiliary power units ("APUs") are gas turbine engines, and therefore, typically include multiple sections that are used to extract energy. These sections include an inlet section, a compression section, a combustor section, a turbine section, and an exhaust nozzle section. The inlet section moves air into the engine. The air is compressed in the compression section. The compressed air is mixed with fuel and is combusted in combustion areas within the combustor section. The products of the combustion expand in the turbine section to rotatably drive the engine. The products of the combustion are exhausted from the APU via an exhaust housing of the exhaust nozzle section.

It is desirable for APU manufacturers to demonstrate that the cases and other structures of the APU are able to limit damage caused by a catastrophic failure of a high energy rotor and blades. One such rotor failure can occur if the turbine wheel breaks into pieces or breaks loose from a bearing capsule and compressor impeller. Such a failure can result in the turbine wheel (or pieces of the turbine wheel) being ejected aft through the exhaust housing of the exhaust nozzle section. Typically, a containment structure is positioned aft of the rotor in order to absorb at least some of the energy of the turbine wheel (or pieces of the turbine wheel) when it fails.

One containment structure design comprises a catcher. The catcher is positioned within the exhaust nozzle section to slow the speed of fragments of the rotor. To date, catcher designs can be susceptible to vibratory excitation, which is detrimental to the operation of the APU, or requires added stiffness to fulfill its design intent.

SUMMARY

A catcher for a gas turbine engine includes a central hub, a plurality of struts, and a first ring. The plurality of struts are connected to and extend outward from the central hub. The first ring is connected to a mid-section of the plurality of struts and extends therebetween.

A catcher for a gas turbine engine includes a central hub, a plurality of struts, a first ring, and a second ring. The plurality of struts are connected to and extend outward from the central hub. The first ring is connected to a mid-section of the plurality of struts and extends therebetween. The second ring is positioned generally radially outward of the first ring and is connected to outer radial ends of the plurality of struts.

A gas turbine engine includes a compressor impeller, a turbine wheel connected to the compressor impeller, and a catcher. The catcher is positioned axially aft of and is spaced at a distance from the turbine wheel. The catcher includes a central hub, a plurality of struts, a first ring, and a second ring. The plurality of struts are connected to and extend outward from the central hub. The first ring is connected to the plurality of struts and extends therebetween. The first ring is positioned within a flow path of the gas turbine engine aft of the turbine wheel. The second ring is positioned generally radially outward of the first ring and is connected to outer radial ends of the plurality of struts.

DETAILED DESCRIPTION

The present disclosure describes a turbine wheel catcher with an inner ring that extends between struts. The inner ring is positioned radially outward of a central hub of the catcher and is positioned within a flow path of a gas turbine engine aft of turbine wheel. The inner ring reduces the susceptibility of the catcher to vibratory excitation. The inner ring additionally acts to stiffen struts and improves the ability of the catcher to act to impede or substantially reduce the speed of aft axial movement of turbine wheel in the event of a catastrophic failure of the turbine wheel. The addition of the inner ring has minimal impact on noise and weight of the gas turbine engine while affording substantial benefits.

Figure 1:
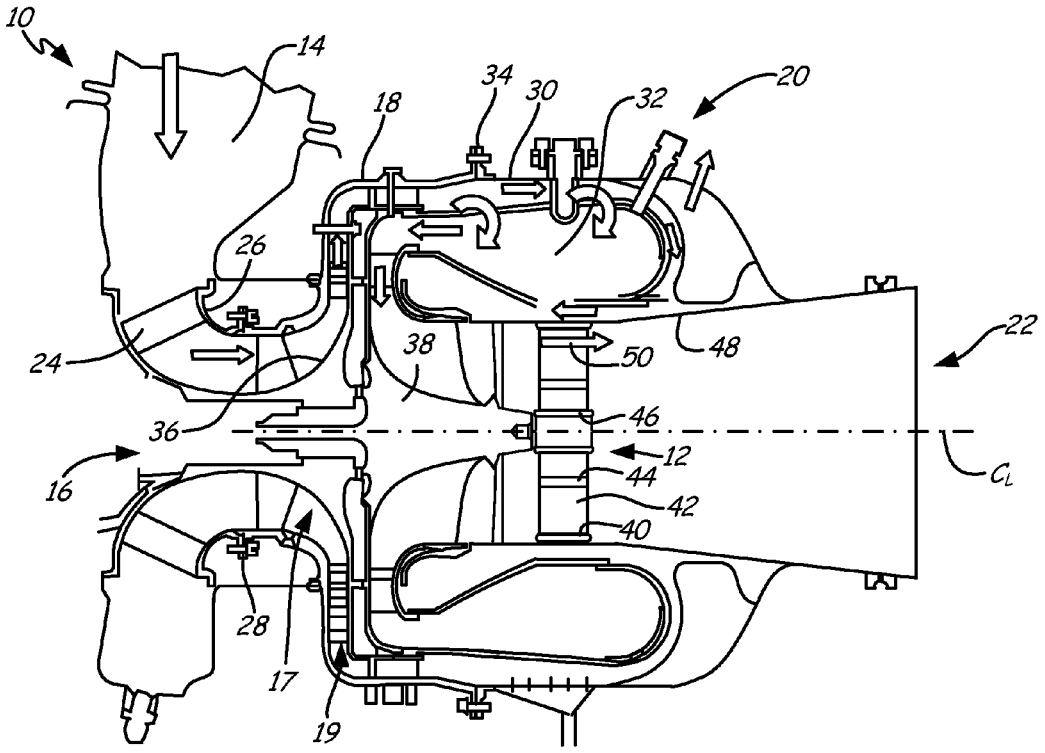
FIG. 1 is a cross-sectional view of an exemplary gas turbine engine.

FIG. 1 shows a cross-section of a gas turbine engine 10 incorporating an embodiment of a catcher 12. Gas turbine engine 10 additionally includes an inlet assembly 14, a bearing capsule 16, a rotor assembly 17, a shroud 18, a diffuser 19, a combustor assembly 20, and an exhaust nozzle assembly 22. Inlet assembly 14 includes a forward inlet 24, a bell mouth 26, and a forward inlet flange 28. Combustor assembly 20 includes a combustor housing 30, a combustor chamber 32, and a combustor flange 34. Inlet assembly 14 includes a compressor impeller 36 and a turbine wheel 38. Catcher 12 includes an outer ring 40, struts 42, an inner ring 44, and a central hub 46. Exhaust nozzle assembly 22 includes an exhaust housing 48.

Gas turbine engine 10 is circumferentially positioned about an engine centerline $C_L$. Catcher 12 is positioned downstream of bearing capsule 16 and rotor assembly 17 within exhaust nozzle assembly 22. Shroud 18, diffuser 19, and combustor assembly 20 are positioned radially outward of bearing capsule 16 and rotor assembly 17.

Forward inlet 24 of inlet assembly 14 is contained within bell mouth 26. Forward inlet 24 and bell mouth 26 are positioned radially outward of bearing capsule 16. Forward inlet flange 28 connects inlet assembly 14 to shroud 18.

Shroud 18 extends to surround diffuser 19 and portions of combustor assembly 20. More particularly, combustor housing 30 attaches to shroud 18 at combustor flange 34. Combustion chamber 32 is positioned radially within combustor housing 30 and is positioned generally radially outward of exhaust nozzle assembly 22 and catcher 12.

Compressor impeller 36 is connected to turbine wheel 38 of rotor assembly 17 along centerline axis $C_L$. Shroud 18 radially surrounds compressor impeller 36 and portions of turbine wheel 38. Thus, shroud 18 extends from inlet assembly 14 to combustor housing 30. Diffuser 19 is attached to shroud 18 by fasteners or other known means.

Catcher 12 is positioned axially aft of and is spaced at a distance from turbine wheel 38. Outer ring 40 of catcher 12 comprises an annular hoop that is connected to exhaust housing 48. One or more struts 42 extend generally radially inward from outer ring 40 to central hub 46. Inner ring 44 extends around central hub 46 between struts 42 and is positioned between central hub 46 and outer ring 40. More particularly, inner ring 44 is positioned radially outward of central hub 46, and is positioned within a flow path 50 of gas turbine engine 10 aft of turbine wheel 38.

During operation, air enters forward inlet 24 at bell mouth 26 and is compressed by the centrifugal action of compressor impeller 36. The compressed air is directed by shroud 18, through diffuser 19, and into combustor housing 30 where it mixes with fuel and is ignited to produce a flame in combustor chamber 32. Diffuser 19 comprises a series of impediments to air flow, such as angled vanes, to slow the compressed air, and increase its pressure, thereby preventing the compressed air from blowing out the flame in combustion chamber 32. High temperature gases produced by the flame expand rapidly and propel turbine wheel 38. Turbine wheel 38, through its attachment to bearing capsule 16, drives compressor impeller 36 and any additional systems attached to bearing capsule 16.

Should turbine wheel 38 suffer a failure and break apart or come free of bearing capsule 16, forces tend to eject the turbine wheel 38 (or portions thereof) aft toward exhaust nozzle assembly 22 as well as outward radially from centerline axis $C_L$. Catcher 12 acts to impede or substantially reduce the speed of aft axial movement of turbine wheel 38 in the event of failure. More particularly, struts 42, inner ring 44, and central hub 46 of catcher 12 act to impede or substantially reduce the speed of aft axial movement of turbine wheel 38 in the event of catastrophic failure of turbine wheel 38.

Figure 2:
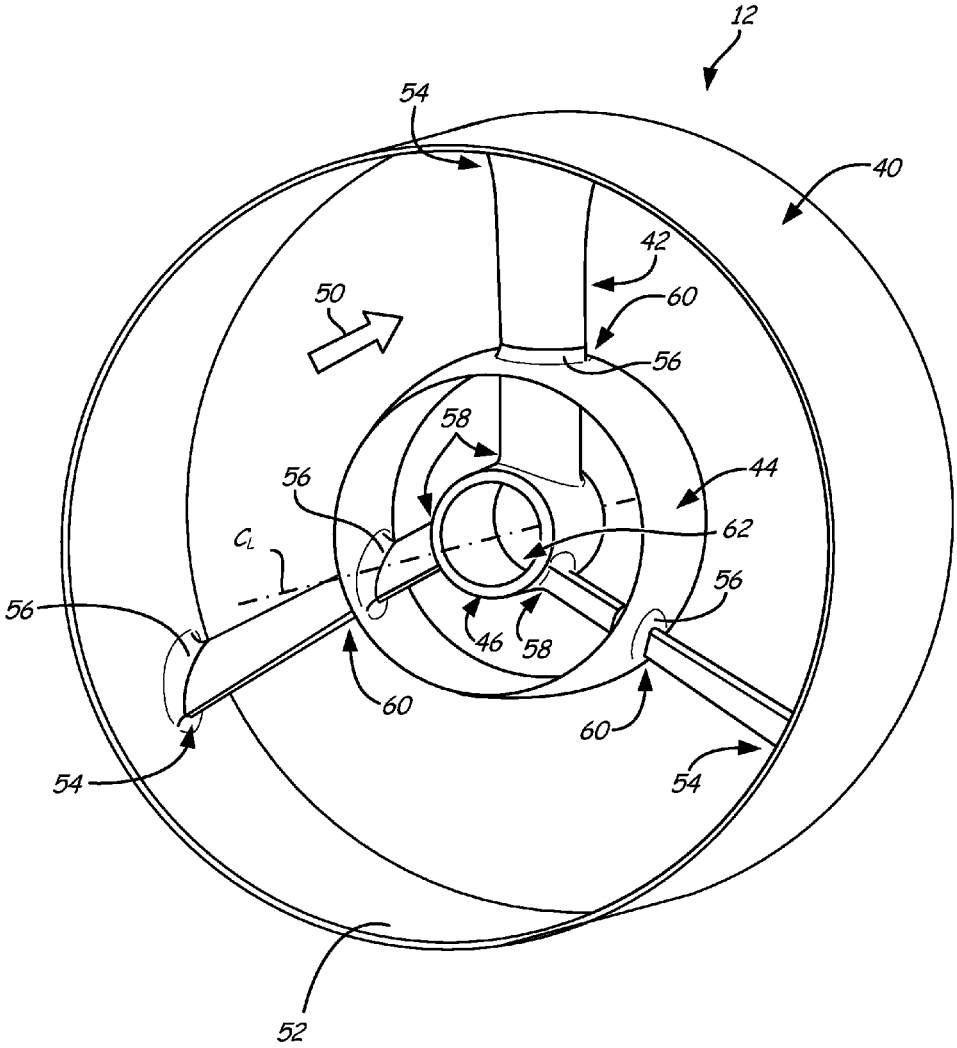
FIG. 2 is a perspective view of one example of a containment structure with a ring positioned outward of a central hub.

FIG. 2 shows one embodiment of catcher 12 including inner ring 14. In FIG. 2, catcher 12 includes aforementioned outer ring 40, struts 42, inner ring 44, and central hub 46, and additionally includes inner surface 52, outer radial ends 54 of struts 42, fillet 56, inner radial ends 58 of struts 42, mid-section 60 of struts 42, and hollow interior 62 of central hub 46.

Outer ring 40 comprises a generally cylindrical hoop that is attached to exhaust housing 48 (FIG. 1) by means such as, for example, brazing, riveting, fastening, and/or welding. Inner surface 52 of outer ring 40 interfaces with and forms a portion of flow path 50 of exhaust nozzle assembly 22 (FIG. 1).

Outer radial ends 54 of struts 42 connect to outer ring 40. Struts 42 extend inward from outer ring 40 and are connected thereto by known means such as, for example, brazing, riveting, fastening, and/or welding. The connection between struts 42 and outer ring 40 may have a fillet 56 as shown. In the embodiment shown in FIG. 2, struts 42 are tilted/canted in an aerodynamic fashion with respect to a direction of airflow along centerline axis $C_L$. In other embodiments, struts 42 may not be tilted/canted such that they would generally align with respect to the direction of airflow. Struts 42 extend to connect to central hub 46 at inner radial ends 58. Although three struts 42 are shown in FIG. 2, a varying number of struts can be used.

Inner ring 44 extends between struts 42 and is connected thereto. In particular, inner ring 44 is connected to a mid-section 60 of struts 42. As with outer ring 40, the connection between inner ring 44 and struts 42 can have fillet 56. The connection of inner ring 44 to struts 42 can be accomplished by, for example, brazing, riveting, fastening, and/or welding. In the embodiment shown in FIG. 2, inner ring 44 has an aerodynamic shape, and is therefore shaped as an airfoil with tapered cross-sectional area forward to aft (with respect to direction of airflow along centerline axis $C_L$). In other embodiments, inner ring 44 can have other shapes such as a hoop shape similar to that of outer ring 40. As described previously, inner ring 44 is positioned radially outward of central hub 46, is connected to mid-section 60 of struts 42, and is positioned within flow path 50 of gas turbine engine 10 aft of turbine wheel 38 (FIG. 1).

Inner radial ends 58 of struts 42 are connected to central hub 46 around a periphery thereof. In the embodiment shown, central hub 46 has a generally annular shape and is positioned symmetrically about centerline axis $C_L$. As shown, central hub 46 has a hollow interior 62. Hollow interior 62 is designed to reduce the weight of catcher 12.

Inner ring 44 reduces susceptibility of catcher 12 to vibratory excitation. Inner ring 44 additionally acts to stiffen struts 42 and improves the ability of catcher 12 to act to impede or substantially reduce the speed of aft axial movement of turbine wheel 38 (FIG. 1) in the event of failure. More particularly, struts 42, inner ring 44, and central hub 46 of catcher 12 act to impede or substantially reduce the speed of aft axial movement of turbine wheel 38 in the event of failure.

The size and geometry of catcher 12 and components thereof including inner ring 44 and struts 42 will vary from embodiment to embodiment based upon design criteria including gas turbine engine size and the results of modal analysis performed utilizing computation fluid dynamics.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine comprising:

a compressor impeller;

a turbine wheel connected to the compressor impeller, wherein the turbine wheel has a center section with a first radial extent at a forward end and second radial extent at an aft end, the second radial extent being less than the first radial extent; and an exhaust housing positioned adjacent an outer perimeter of the turbine wheel, wherein the exhaust housing forms an outer boundary for a flow path directly aft of the turbine wheel;

a catcher positioned axially aft of and spaced at a distance from the turbine wheel, wherein the catcher comprises:

a central hub positioned directly aft of the turbine wheel, wherein the central hub has a radial extent substantially matching the second radial extent;

a plurality of struts connected to and extending outward from the central hub;

a first ring connected to the plurality of struts and extending therebetween wherein the first ring is positioned within a flow path of the gas turbine engine aft of the turbine wheel and in a radial position between the first radial extent and the second radial extent; and a second ring positioned generally radially outward of the first ring and connected both to outer radial ends of the plurality of struts and to an inner perimeter of the exhaust housing, wherein the second ring has an inner radial surface positioned along the flow path of the gas turbine engine aft of the turbine wheel.

2. The gas turbine engine of claim 1, wherein the second ring is connected to the exhaust housing of the gas turbine engine.

3. The gas turbine engine of claim 1, wherein the first ring is connected to a mid-section of the plurality of struts.

4. The gas turbine engine of claim 1, wherein the first ring is shaped as an airfoil.

5. The gas turbine engine of claim 1, wherein the struts are tilted with respect to a direction of airflow along the gas turbine engine.

6. The gas turbine engine of claim 1, wherein the central hub has a hollow interior.

7. The gas turbine engine of claim 1, wherein the first ring has a leading edge and the second ring has a forward edge and, wherein the leading edge of the first ring is positioned aft of the forward edge of the second ring.

8. The gas turbine engine of claim 1, wherein the turbine wheel is a centrifugal turbine wheel.

9. A turbine wheel catcher assembly for use in a gas turbine engine comprising:

a turbine wheel having a center section with a first radial extent at a forward end and second radial extent at an aft end, the second radial extent being less than the first radial extent;

an exhaust housing positioned adjacent the turbine wheel, wherein the exhaust housing forms an outer boundary for a flow path directly aft of the turbine wheel; and a catcher comprising:

a central hub positioned directly aft of the turbine wheel, wherein the central hub has a radial extent substantially matching the second radial extent;

a plurality of struts connected to and extending outward from the central hub;

a first ring connected to a mid-section of the plurality of struts and extending therebetween, and wherein the first ring is positioned within the flow path aft of the turbine wheel and in a radial position between the first radial extent and the second radial extent; and a second ring positioned generally radially outward of the first ring and connected both to outer radial ends of the plurality of struts and to an inner perimeter of the exhaust housing, wherein the second ring has an inner radial surface positioned along the flow path aft of the turbine wheel.

10. The turbine wheel catcher assembly of claim 9, wherein the first ring is shaped as an airfoil.

11. The turbine wheel catcher assembly of claim 9, wherein the struts, first ring, and central hub of the catcher act to impede or substantially reduce a speed of aft axial movement of the turbine wheel in the event of a catastrophic failure of the turbine wheel.

12. The turbine wheel catcher assembly of claim 9, wherein the struts are tilted with respect to a direction of airflow along the catcher.

13. The turbine wheel catcher assembly of claim 9, wherein the central hub has a hollow interior.

14. The turbine wheel catcher assembly of claim 9, wherein an outer perimeter surface of the second ring abuts an inner perimeter surface of the exhaust housing.

15. The turbine wheel catcher assembly of claim 9, wherein the second ring is hoop-shaped.

16. The turbine wheel catcher assembly of claim 9, wherein the first ring has a leading edge and the second ring has a forward edge and, wherein the leading edge of the first ring is positioned aft of the forward edge of the second ring.

17. The turbine wheel catcher assembly of claim 9, wherein the turbine wheel is a centrifugal turbine wheel.

18. A turbine wheel catcher assembly for a gas turbine engine, comprising:

a turbine wheel having a center section with a first radial extent at a forward end and second radial extent at an aft end, the second radial extent being less than the first radial extent;

an exhaust housing positioned adjacent an outer perimeter of the turbine wheel, wherein the exhaust housing forms an outer boundary for a flow path directly aft of the turbine wheel;

a central hub positioned directly aft of the turbine wheel, wherein the central hub has a radial extent substantially matching the second radial extent;

a plurality of struts connected to and extending outward from the central hub, wherein the struts are tilted with respect to a direction of airflow along the gas turbine engine;

a first ring connected to a mid-section of the plurality of struts and extending therebetween, wherein the first ring is positioned within a flow path aft of the turbine wheel and in a radial position between the first radial extent and the second radial extent; and a second ring positioned generally radially outward of the first ring and connected both to outer radial ends of the plurality of struts and to an inner perimeter of the exhaust housing, wherein the second ring has an inner radial surface positioned along the flow path aft of the turbine wheel.

19. The turbine wheel catcher assembly of claim 18, wherein the turbine wheel is a centrifugal turbine wheel.

* * * * *